United States Patent [19]

Kingsford

[11] 4,194,848

[45] Mar. 25, 1980

[54] ADJUSTABLE COSMETIC WIPER

[75] Inventor: Ted I. Kingsford, Memphis, Tenn.

[73] Assignee: Plough, Inc., Memphis, Tenn.

[21] Appl. No.: 857,074

[22] Filed: Dec. 5, 1977

[51] Int. Cl.[2] ..... A46B 11/04

[52] U.S. Cl. ..... 401/5; 132/88.7; 138/45; 215/228; 401/122; 401/128; 401/129; 401/207

[58] Field of Search ..... 174/62; 132/88.5, 88.7; 15/257.05; 206/15.2, 228; 138/43–46; 401/5, 118, 119, 120, 122, 123, 129, 207, 128; 215/227, 228

[56] References Cited

U.S. PATENT DOCUMENTS

| | | | |
|---|---|---|---|
| 565,328 | 8/1896 | Buhler | 401/122 |
| 718,625 | 1/1903 | Hinkel | 15/257.05 |
| 1,657,663 | 1/1928 | Devereux | 138/45 |
| 2,261,531 | 11/1941 | Thomas | 138/45 |
| 2,518,625 | 8/1950 | Langstaff | 138/45 |
| 2,622,258 | 12/1952 | Giraud | 401/118 |
| 3,095,175 | 6/1963 | Iketani | 138/45 |
| 3,214,782 | 11/1965 | Masters | 15/521 |
| 3,471,244 | 10/1969 | Melocchi | 401/122 |
| 3,549,266 | 12/1970 | Vasas | 401/122 |
| 3,662,769 | 5/1972 | Vasas et al. | 132/88.7 |
| 3,861,810 | 1/1975 | Vasas | 401/122 |
| 3,870,186 | 3/1975 | Reinhard | 220/212 |
| 3,883,254 | 5/1975 | Vasas | 401/122 |
| 3,908,675 | 9/1975 | Spatz | 132/82 R |
| 3,998,235 | 12/1976 | Kingsford | 401/128 |

FOREIGN PATENT DOCUMENTS

| | | | |
|---|---|---|---|
| 765719 | 3/1934 | France | 401/122 |
| 222794 | 10/1924 | United Kingdom | 138/45 |

*Primary Examiner*—Clyde I. Coughenour
*Attorney, Agent, or Firm*—Vincent H. Gifford; Bruce M. Eisen

[57] ABSTRACT

A wiper for a cosmetic applicator in which the size of the wiper orifice is adjustable.

31 Claims, 11 Drawing Figures

ADJUSTABLE COSMETIC WIPER

This invention relates to an improved device for applying a predetermined metered amount of a cosmetic. More particularly, the device relates to a wiper for a non-rigid mascara applicator, e.g. a brush, in which the quantity of mascara which is retained by the applicator is predetermined by manually adjusting the size of the wiper orifice.

In most mascara products, the applicator is disposed in a mascara mass within the cosmetic container. The excess mascara is removed by an elastic wiper as the applicator is withdrawn from the container. A set amount of cosmetic remains within or on the applicator for application to the eyelashes. In any given application, essentially the same quantity of mascara is retained regardless of the length, thickness or density of the users' lashes, and without regard as to whether the upper or lower lashes are to be treated.

In accordance with the present invention, it will now be possible for the mascara user to retain the applicator the quantity of mascara suited for her lashes, particularly her upper lashes. A user can therefore apply, at her discretion, either a heavy or thin coating of mascara by merely selecting the volume of mascara which is to be retained on the applicator. The mascara volume is determined by selecting an appropriate diameter or cross-sectional area for the wiper orifice. A user with skimpy, sparsely distributed lashes or one who prefers maximum separation between the lashes will no longer be burdened with the mess associated with an excessive quantity of mascara. A user with full lashes will now be able to uniformly coat her lashes more rapidly without the need for constant recoating of the applicator. It will also be possible for the user to select the quantity of mascara suited to her lower lashes which are invariably shorter and less dense than the upper lashes. A user can also control the degree to which the individual lashes stick together. For example, for evening use some women prefer the "cluster" or "starry" look which results when the individual lashes stick together in discrete clusters.

Accordingly, it is an object of the present invention to provide a mascara applicator which will enable the user to select the amount of mascara which is to be applied.

It is a further object to provide a mascara applicator which will hold the amount of mascara suited for both the upper and lower lashes of any individual user.

It is a further object to provide a brush-type applicator which will hold a proper amount of a pasty, liquid, semi-liquid or powder product in which a predetermined metered amount of the product is to be dispensed.

Figure 1:
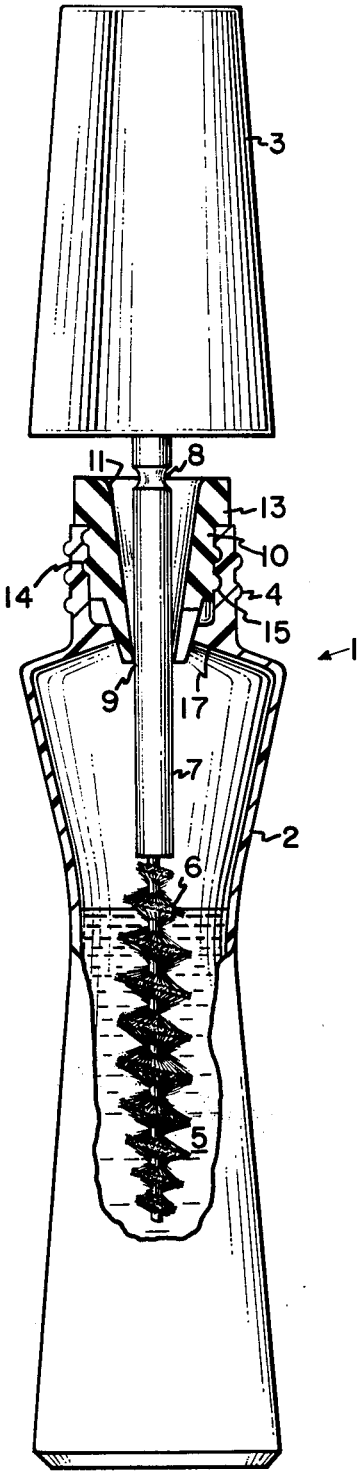
FIG. 1 is a longitudinal sectional view of an adjustable wiper within a fully assembled mascara container.

Referring to FIG. 1, there is illustrated an eyelash cosmetic package 1 that consists of a container or tubular reservoir 2 and a cap 3. The cap 3 is provided with internal threads (not visible) which mesh with the external threads 4 of container 2. The container is shown partly filled with a cosmetic composition 5.

A non-rigid mascara applicator 6, e.g., a brush, is attached to the cap 3 by a shaft or rod 7 with the cap serving as a handle for the applicator. The shaft 7 has a reduced portion 8 which is adjacent to the wiper orifice 9 when the closure is fully tightened onto the container. This minimizes any deforming stress on the wiper when it is not in use.

The wiper 10 comprises a tubular frame which is positioned within the neck of the container. The interior wall 11 of the wiper is tapered toward the bottom of the container. The wiper has an integral dial ring 13 at one end and a wiper orifice 9 at the other end. The wiper has a guide means 14 which mates with a corresponding guide means 15 in the wall of the container neck. In FIG. 1 the guide means is shown as a screw thread. The wiper contains at least one longitudinal slit 16. The bottom of the frame is within the opening formed by container ledge 17. At least a portion of the wiper 10 would be located within the container 2, preferably within the neck of the container.

Rotation of the dial ring 13 moves the wiper longitudinally within the container, thereby changing the diameter of the wiper orifice 9 as it is compressed or expanded by the ledge 17. The longitudinal slit(s) 16 relieves the compression of the wiper mass and permits the wiper orifice to change in diameter while maintaining a generally circular configuration. The preferred embodiment would have at least four longitudinal slits which diverge toward the bottom of the container when it is assembled.

Figure 2:
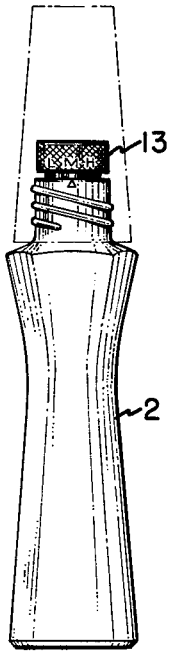
FIG. 2 is a longitudinal view of the mascara container of FIG. 1.

FIG. 2 shows a cosmetic container having three indicia for the diameter or cross-sectional area of the orifice. Each of the indicia correspond to a specific, preselected, reproducable orifice size. On the "L" (Low) setting the wiper orifice would have a minimum cross-sectional area so that only a small amount of cosmetic is retained by the applicator. On the "H" (High) setting the wiper orifice would have a maximum cross-sectional area, thereby leaving a large quantity of cosmetic. The "M" setting would be a medium position. Obviously any number of settings would be used. The settings provide a means to allow the user to reproduce a previous use.

Figure 3:
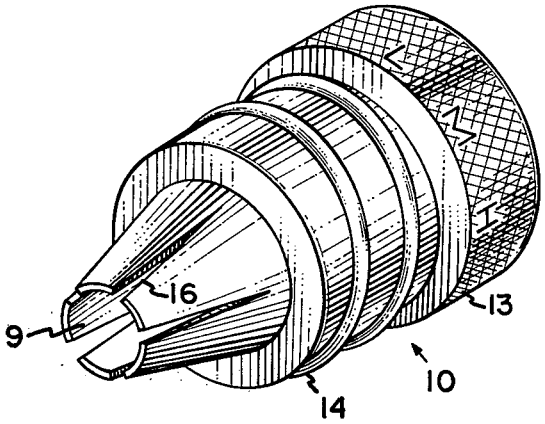
FIG. 3 is an enlarged perspective view of the wiper shown in FIG. 1.

FIG. 3 is a perspective view of the wiper shown in FIG. 1.

Figure 4:
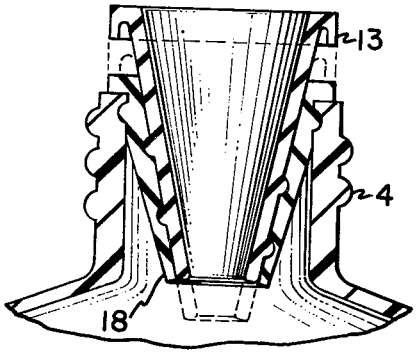
FIG. 4 is a cross-sectional view of a wiper variant within the container neck.

FIG. 4 is a sectional view of another wiper embodiment positioned within the container neck. The wiper is similar to the FIG. 1 embodiment except that it is supported by a sleeve means 18. The sleeve is positioned between the wiper and the container neck and comprises a tubular member which is tapered toward the bottom of the container. Rotation of the dial ring relative to the container moves the wiper longitudinally and changes the diameter of the wiper orifice. The dotted lines show the position of the wiper when adjusted to its minimum orifice size.

Figure 5:
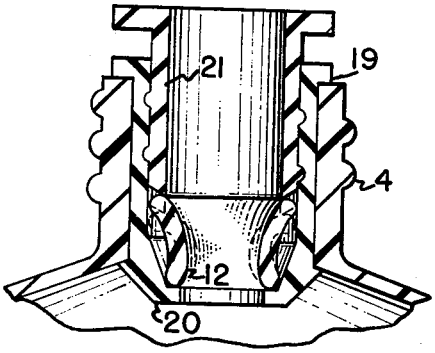
FIG. 5 is a cross-sectional view of another wiper variant within the container neck.

FIG. 5 is a side view of another wiper embodiment in the container neck. The wiper 12 is supported by a longitudinal sleeve 19 having a ledge 20. The wiper 12 is compressed by a driving member 21 which is located above the wiper. Rotation of the driving member will compress the wiper to the position shown by dotted lines.

Figure 6:
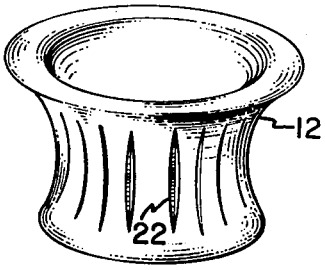
FIG. 6 is a perspective view of the FIG. 5 wiper.

FIG. 6 is a perspective view of the wiper 12 shown in FIG. 5. The wiper is a doughnut shaped annulus containing a series of longitudinal slits 22 in the outer wall of the annulus. The slits, which extend only partly through the wiper, relieve the compression of the mass. At least four of the slits uniformly spaced about the wiper are preferred. Alternatively, the slits could be located on the inner surface of the wiper or cut through the entire wiper mass.

Figure 7:
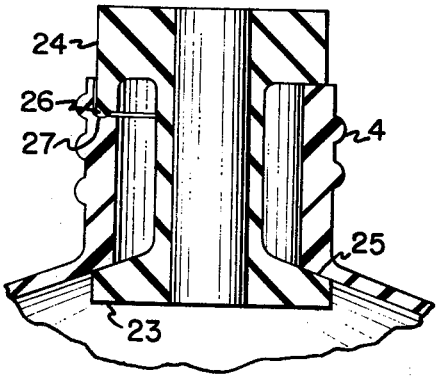
FIG. 7 is a cross-sectional view of another wiper variant.
Figure 8:
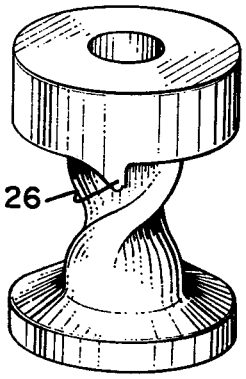
FIG. 8 is a perspective view of the wiper of FIG. 7 as it is twisted.

FIGS. 7–8 show another embodiment of wiper consisting of a tubular frame. The bottom 23 of the frame is fixed to the container at 25 by an adhesive or similar means. The top 24 of the frame is free to rotate relative to the container. Rotation of the top portion of the wiper to the twisted position shown in FIG. 8 restricts the cross-sectional area of the wiper orifice. The wiper is held in position by the detent 26 which fits in a corresponding indent in the container wall. A series of indents corresponding to each setting on the wiper would be provided.

Figure 9:
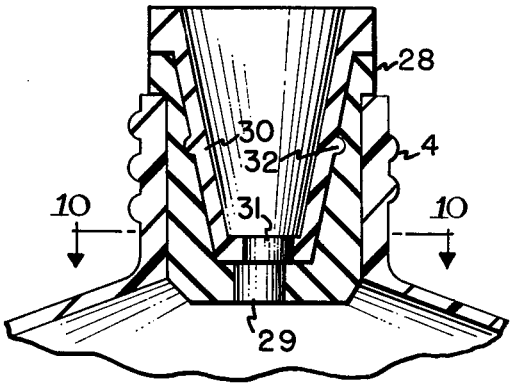
FIG. 9 is a cross-sectional view of another wiper variant within the container neck.
Figure 10:
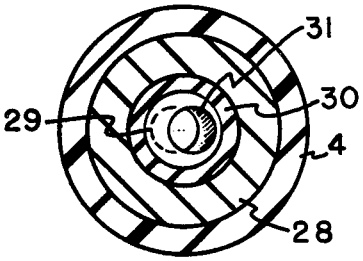
FIG. 10 is a top view along lines 10—10 of FIG. 9 showing the wiper orifice at its minimum size.
Figure 11:
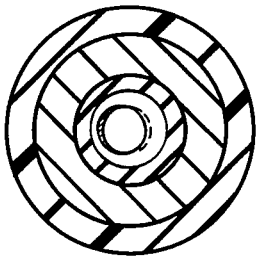
FIG. 11 is a top view similar to FIG. 10 but showing the orifice at its maximum size.

FIG. 9 is a side view of another wiper embodiment within the container neck. The wiper comprises a sleeve member 28 having a first opening 29 and a rotatable frame means 30 having a second opening 31 which is adjacent and off-center to the first opening. The two members are rotatably attached to one another through a tongue and groove means 32 which is perpendicular to the container axis. The overlapping portions of the two openings comprise the wiper orifice. Rotation of the frame varies the cross-sectional area of the wiper orifice between the minimum and maximum orifice sizes shown in FIGS. 10 and 11, respectively.

The non-rigid applicator head is preferably a radial bristle brush such as shown in U.S. Pat. Nos. 3,214,782 and 3,870,186. Other non-rigid applicators such as the longitudinal bristle brush shown in U.S. Pat. No. 3,883,254; the foam tipped applicator as shown in U.S. Pat. No. 3,908,675; or the variable applicator shown in U.S. Pat. No. 3,998,235 would also be suitable. The wiper is preferably made of an elastomeric or a thermoformed plastic material having a slight resiliency.

The preferred mascara package is a mascara product in which the applicator is an elongated radial bristle brush having a tapered head, an overall diameter of 3–10 mm and an overall length of 5–35 mm. The wiper orifice has a cross-sectional area which can be varied between 6 and 15 $mm^2$. In the case of a substantially circular orifice, the orifice diameter would generally be varied between 2.5 and 4.5 $mm^2$. The mascara composition could be either solvent or water based.

The wiper disclosed herein can be used in a variety of applications other than for mascara. For example, it could be used to control the amount of material used in coloring an eyebrow, moustache, beard or hair upon the head, or to meter the amount of any pasty, liquid, semi-liquid or powder product which was a cosmetic, medicament or otherwise.

While several embodiments have been shown to illustrate the invention, it will be understood by those skilled in the art that various changes and modifications can be made without departing from the scope of the invention.

What is claimed is:

1. A cosmetic package comprising:

a. a container having a cosmetic composition therein;

b. a container closure;

c. a wiper having an orifice means adapted to wipe excess cosmetic from the applicator;

d. a cosmetic applicator attached to said closure by a shaft and adapted to be passed through said wiper orifice and immersed in said cosmetic composition when said closure is attached to said container;

e. adjusting means to vary the cross sectional area of said orifice;

f. indicating means comprising a plurality of indicia, each indicia corresponding to a different orifice cross-sectional area; and g. means to position said indicia to correspond to the selected orifice cross-sectional area.

2. A cosmetic package as in claim 1 wherein at least a portion of said wiper is rotatable with respect to said container, and wherein rotation of said wiper comprises said adjusting means.

3. A cosmetic package as in claim 2 wherein said adjusting means comprises a first guide means in said wiper and a second guide means in the neck of said container, wherein said first and second guide means mate with one another.

4. A cosmetic package as in claim 3 wherein said first and second guide means comprise a screw thread.

5. A cosmetic package as in claim 1 wherein at least a portion of said wiper is within the neck of said container and wherein said package further comprises a supporting sleeve positioned between the neck of said container and said wiper.

6. A cosmetic package as in claim 5, further comprising a driving member located above said wiper, wherein said adjusting means comprises a first guide means in said driving member and a second guide means in said sleeve, and further, wherein said first and second guide means mate with one another.

7. A cosmetic package as in claim 6 wherein said first and second guide means comprise a screw thread.

8. A cosmetic package as in claim 1 wherein said wiper consists of a tubular frame having a longitudinal axis which is parallel to the longitudinal axis of said container.

9. A cosmetic package as in claim 8 wherein the interior surface of said tubular frame is tapered.

10. A cosmetic package as in claim 9 wherein said tubular frame has a least one longitudinal slit to relieve the compression of the wiper mass.

11. A cosmetic package as in claim 10 wherein said tubular frame has at least four longitudinal slits.

12. A cosmetic package as in claim 10 wherein each of said slits diverge outwardly toward the bottom of said container.

13. A cosmetic package as in claim 8 wherein the bottom of said tubular frame is fixed to said container and the top of said tubular frame is rotatable relative to said container, whereby rotation of the top of said tubular frame relative to said container comprises said adjusting means.

14. A cosmetic package as in claim 1 further comprising a tubular frame abutting said wiper and adapted to move longitudinally with respect to the container axis, whereby longitudinal movement of said frame exerts a force on said wiper and comprises said adjusting means.

15. A cosmetic package as in claim 14 further comprising a supporting sleeve positioned between said tubular frame and the neck of said container, a first guide means in the outer periphery of said tubular frame and a second guide means in the interior surface of said sleeve means, wherein said first and second guide means mate with one another.

16. A cosmetic package as in claim 15 wherein said wiper is supported by said sleeve.

17. A cosmetic package as in claim 16 wherein said wiper is doughnut-shaped and has at least one longitudinal slit means adapted to relieve the compression of the wiper mass.

18. A cosmetic package as in claim 1 wherein said wiper comprises a sleeve having a first opening and a frame means having a second opening which is adjacent to and off-center of said first opening, wherein the portion of each of said openings which overlap comprises said orifice means, and rotation of said sleeve means relative to said frame means comprises said adjusting means.

19. A cosmetic package as in claim 1 wherein said applicator is non-rigid.

20. A cosmetic package as in claim 19 wherein said applicator is a brush.

21. A cosmetic package as in claim 20 wherein said brush comprises a plurality of radial bristles.

22. A cosmetic package as in claim 20 wherein said brush is tapered.

23. A cosmetic package as in claim 20 wherein said brush has an overall diameter of 3–10 mm and an overall length of 5–35 mm.

24. A cosmetic package as in claim 20 wherein said adjusting means is adapted to adjust the cross-sectional area of the orifice between 6 and 15 $mm^2$.

25. A cosmetic package as in claim 19 wherein said applicator is made of a compressible foam material.

26. A cosmetic package as in claim 1 wherein said orifice is substantially circular.

27. A cosmetic package as in claim 1 wherein said cosmetic composition is a pasty, liquid or semi-liquid material.

28. A cosmetic package as in claim 1 wherein said cosmetic composition is a powder.

29. A cosmetic package as in claim 1 wherein said shaft has a reduced portion which is positioned adjacent to said orifice means when said closure is fully tightened onto the container neck.

30. An applicator as in claim 1 wherein said indicia are located on a dial ring which is rotatable relative to said container.

31. A cosmetic package as in claim 1 wherein said adjusting means has at least three indicia, each corresponding to a different orifice area.

* * * * *